US008665168B2

(12) United States Patent
Wang

(10) Patent No.: US 8,665,168 B2
(45) Date of Patent: Mar. 4, 2014

(54) MUTUALLY INDUCTIVE RESONANT ANTENNA

(75) Inventor: Gary Wang, Taoyuan County (TW)

(73) Assignee: Yi Chang Hsiang Industrial Co., Ltd., Taoyuan County (TW)

( * ) Notice: Subject to any disclaimer, the term of this patent is extended or adjusted under 35 U.S.C. 154(b) by 335 days.

(21) Appl. No.: 13/289,371

(22) Filed: Nov. 4, 2011

(65) Prior Publication Data

US 2013/0113679 A1 May 9, 2013

(51) Int. Cl.
*H01Q 9/04* (2006.01)

(52) U.S. Cl.
USPC ..... 343/790; 343/791; 343/872

(58) Field of Classification Search
USPC ..... 343/872, 790, 791
See application file for complete search history.

(56) References Cited

U.S. PATENT DOCUMENTS

| | | | | |
|---|---|---|---|---|
| 6,842,155 | B1 * | 1/2005 | Yeh | 343/790 |
| 8,259,025 | B2 * | 9/2012 | Swais et al. | 343/790 |
| 8,378,913 | B2 * | 2/2013 | Tao et al. | 343/790 |
| 2006/0125707 | A1 * | 6/2006 | Waschenko | 343/790 |

* cited by examiner

*Primary Examiner* — Tan Ho
(74) *Attorney, Agent, or Firm* — Muncy, Geissler, Olds & Lowe, P.C.

(57) ABSTRACT

A mutually inductive resonant antenna receiving radio waves of dual frequency bands improves a conventional antenna series-connected to a uniaxial wire. The mutually inductive resonant antenna receives FM or TMC radio waves and comprises a first antenna and a second antenna. The first antenna has a first conductive core wire and a first insulating layer. The first insulating layer encloses the first conductive core wire. The second antenna has a second mesh-like conductive layer and a second insulating layer. The second mesh-like conductive layer encloses a section of the first antenna such that another section of the first antenna is exposed. The second insulating layer encloses the second mesh-like conductive layer. A section of the second mesh-like conductive layer is extended from the first antenna and electrically connected to a signal transmission line. The second mesh-like conductive layer is not in contact with the first conductive core wire.

3 Claims, 5 Drawing Sheets

MUTUALLY INDUCTIVE RESONANT ANTENNA

FIELD OF THE INVENTION

The present invention relates to mutually inductive resonant antennas, and more particularly, to a mutually inductive resonant antenna capable of receiving radio waves of dual frequency bands.

BACKGROUND OF THE INVENTION

Vehicle-oriented satellite navigation systems are all the rage, as they allow drivers to search maps, plan itineraries, and perform real-time locating. To enable drivers on roads to access real-time coverage of road conditions and weather, vehicle-oriented satellite navigation systems nowadays are equipped with a built-in receiving module for use with Traffic Message Channel (TMC). TMC is a communication application in real-time coverage of traffic and weather, and is effective in providing real-time coverage of traffic and weather by radio communication technology as well as enhancing the real-time characteristic and accuracy in prediction of road conditions by a navigation device. The navigation device operates in conjunction with a TMC receiving apparatus and makes good use of related information and drawings so as to inform, by voice, graphic, or text, users of related real-time information. Among the ways of transmitting messages by TMC, the commonest is FM subcarrier TMC which has the widest use in Europe nowadays.

To enable the aforesaid vehicle-oriented satellite navigation systems to receive TMC radio waves, related prior art teaches an antenna as shown in FIG. 1. The antenna essentially comprises a uniaxial wire 10 of a length equal to a fourth of the wavelength of radio waves intended to be received and transmitted at intended frequencies (a single frequency domain). Hence, to receive radio waves of two frequency domains, such as 76 MHz~90 MHz (Japan) and 88 MHz~108 MHz (Taiwan), the uniaxial wire 10 has to be series-connected to another uniaxial wire operable at another wavelength. However, a series-connected antenna structure causes the narrowing of a bandwidth and prevents the optimization of the voltage standing wave ratio (VSWR).

Accordingly, it is imperative to invent an antenna capable of overcoming the aforesaid drawbacks of the prior art.

SUMMARY OF THE INVENTION

In view of the drawbacks of the prior art, the inventor of the present invention believed that there are rooms for improvement of the prior art and thus conducted extensive researches and experiments according to the inventor's years of experience in the related industry, and finally developed a mutually inductive resonant antenna as disclosed in the present invention to achieve the objective of receiving radio waves of dual frequency bands.

In order to achieve the above and other objectives, the present invention provides a mutually inductive resonant antenna for receiving FM radio waves or TMC (Traffic Message Channel) radio waves. The mutually inductive resonant antenna comprises a first antenna and a second antenna. The first antenna has at least one first conductive core wire and a first insulating layer. The first insulating layer encloses the first conductive core wire. The second antenna has a second mesh-like conductive layer and a second insulating layer. The second mesh-like conductive layer encloses a section of the first antenna, such that another section of the first antenna is exposed. The second insulating layer encloses the second mesh-like conductive layer. A section of the second mesh-like conductive layer is extended from the first antenna and electrically connected to a signal transmission line. The second mesh-like conductive layer is not in contact with the first conductive core wire.

The first antenna is of a length ranging between 75 cm and 85 cm, and the second antenna is of a length ranging between 60 cm and 70 cm.

Another end of the first antenna is enclosed by a first protective sleeve. A portion of the first antenna is exposed from the second antenna, and the exposed portion of the first antenna is enclosed by a second protective sleeve.

Accordingly, the mutually inductive resonant antenna of the present invention is capable of receiving radio waves of dual frequency bands.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
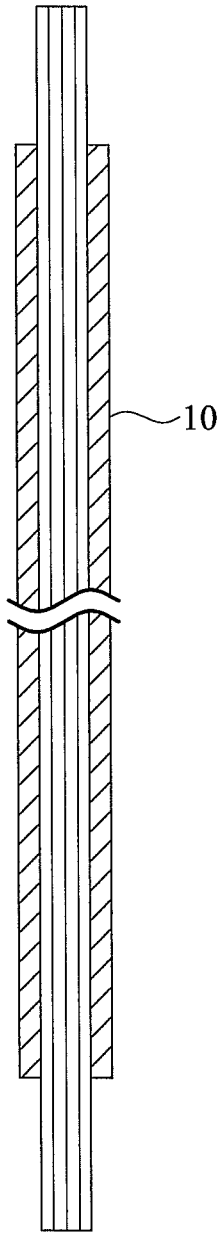
FIG. 1 (PRIOR ART)
FIG. 1 (PRIOR ART) is a cross-sectional schematic view of a conventional antenna.
Figure 2:
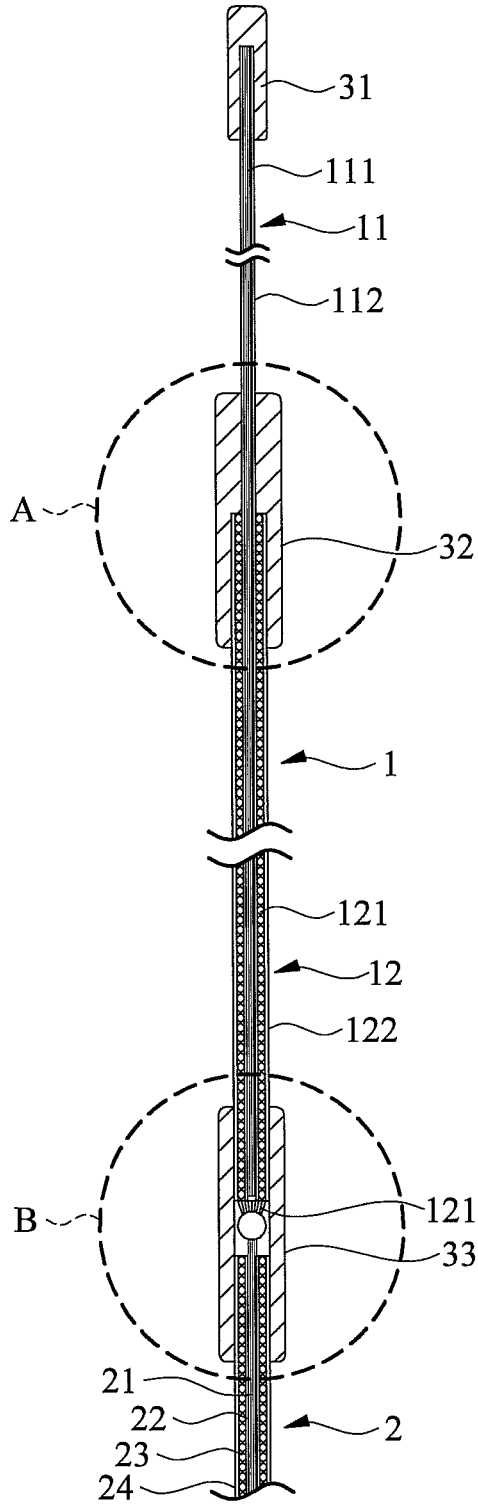
FIG. 2 is a cross-sectional schematic view of a specific embodiment of the present invention.
Figure 3:
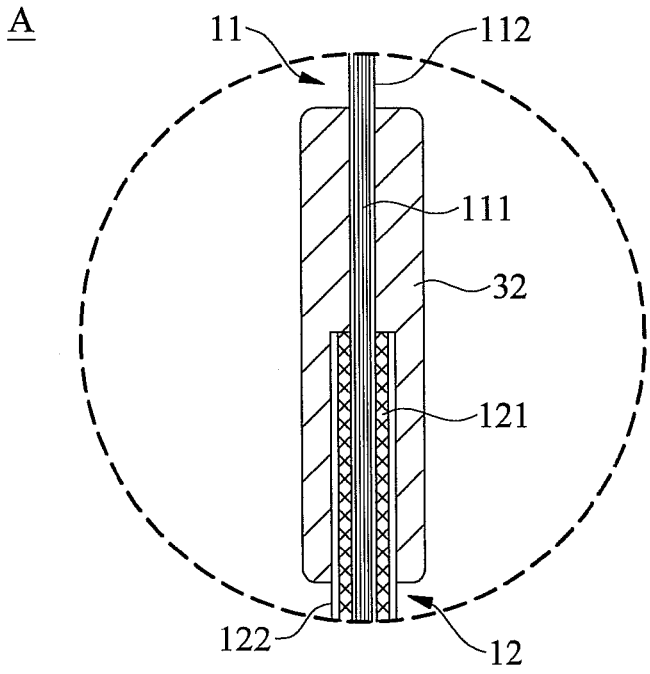
FIG. 3 is an enlarged diagram of the encircled part A of FIG. 2.
Figure 4:
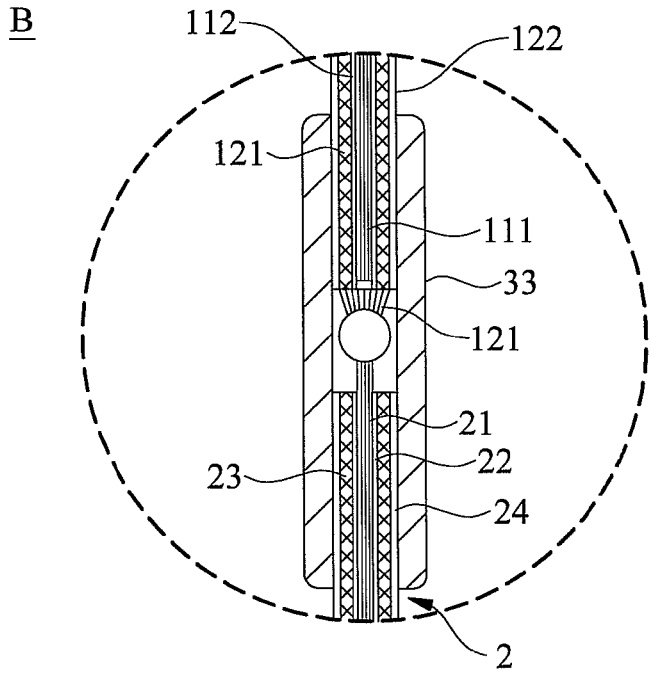
FIG. 4 is an enlarged diagram of the encircled part B of FIG. 2.
Figure 5:
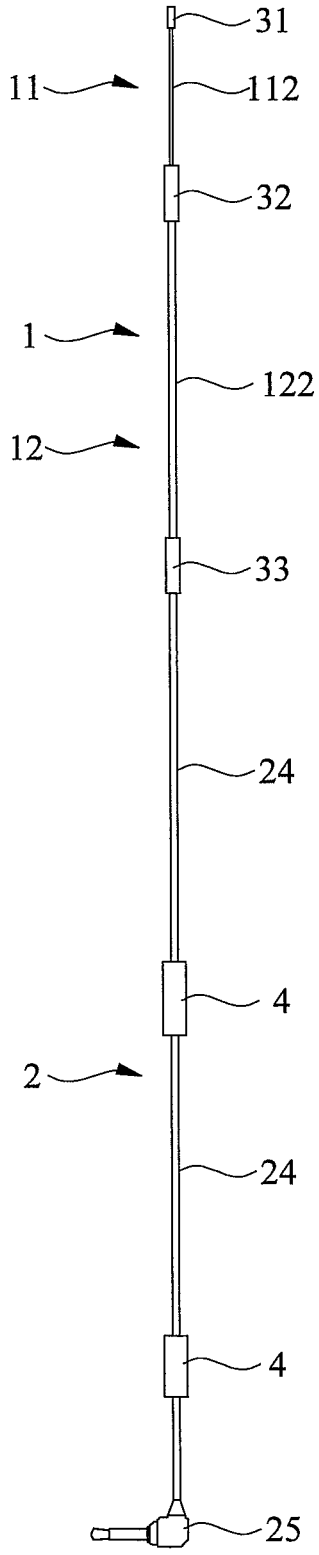
FIG. 5 is a schematic view of application of the specific embodiment of the present invention.

FIG. 2 through FIG. 4, there are shown cross-sectional schematic views of a specific embodiment of the present invention, including enlarged diagrams encircled by dashed line A and dashed line B, respectively. As shown in the drawings, a mutually inductive resonant antenna 1 of the present invention is for use in receiving FM radio waves or TMC (Traffic Message Channel) radio waves. The mutually inductive resonant antenna 1 comprises a first antenna 11 and a second antenna 12. The first antenna 11 has at least one first conductive core wire 111 and a first insulating layer 112. The first insulating layer 112 is arranged in a pipe-shaped configuration to enclose the first conductive core wire 111. The upper and lower ends of the pipe-shaped first insulating layer 112 are open. The second antenna 12 has a second mesh-like conductive layer 121 and a second insulating layer 122. The second mesh-like conductive layer 121 is arranged in a pipe-shaped configuration to enclose a section of the first antenna 11 (or a section of the pipe-shaped first insulating layer 112) such that the other section of the first antenna 11 (or the other section of the pipe-shaped first insulating layer 112) is exposed. The upper end of the pipe-shaped second mesh-like conductive layer 121 is open. The second insulating layer 122 is arranged in a pipe-shaped configuration to enclose the second mesh-like conductive layer 121. The upper and lower ends of the pipe-shaped second insulating layer 122 are open. The lower end of the pipe-shaped second mesh-like conductive layer 121 extends downward from the first antenna 11, and a section of the extending lower end (or a section of the lower end of the pipe-shaped first insulating layer 112) is electrically connected to a signal transmission line 2 (as shown in FIG. 5, and the way of implementing its electrical connection is described later). With the pipe-shaped first insulating layer 112 being disposed between the second mesh-like conductive layer 121 and the first conductive core wire 111, the second mesh-like conductive layer 121 is not in contact with the first conductive core wire 111. It is feasible to make the first conductive core wire 111 shorter than the pipe-shaped first insulating layer 112 or hermetically seal the lower end of the pipe-shaped first insulating layer 112 so as to ensure that the second mesh-like conductive layer 121 cannot come into contact with the first conductive core wire 111. Hence, the mutually inductive resonant antenna 1 of the present invention is capable of receiving radio waves of dual frequency bands, that is, FM radio waves or TMC radio waves. For example, the first antenna 11 can receive radio waves of frequencies 76 MHz~90 MHz (Japan), and then mutual electromagnetic induction between the first antenna 11 and the second antenna 12 enables the received radio waves to be transmitted to the signal transmission line 2 via the second antenna 12. The second antenna 12 can receive radio waves of frequencies 88 MHz~108 MHz (Taiwan), and then the received radio waves are transmitted to the signal transmission line 2. Furthermore, in the specific embodiment of the present invention, the first antenna 11 and the second antenna 12 of the mutually inductive resonant antenna 1 are neither connected in series nor connected in parallel, thereby precluding a conflict between the two frequency domains, variation in the bandwidth, and deterioration of the voltage standing wave ratio (VSWR).

The first antenna 11 is of a length ranging between 75 cm and 85 cm, and the second antenna 12 is of a length ranging between 60 cm and 70 cm, wherein the length equals a fourth of the wavelength of radio waves intended to be received and transmitted at intended frequencies.

The upper end of the first antenna 11 is enclosed by a first protective sleeve 31. A portion of the first antenna 11 is exposed from the second antenna 12, and the exposed portion of the first antenna 11 is enclosed by a second protective sleeve 32. Hence, the protective sleeve 31 and the second protective sleeve 32 together prevent any foreign body from intruding into the mutually inductive resonant antenna 1 and protect the mutually inductive resonant antenna 1 against any external force, which might otherwise damage the mutually inductive resonant antenna 1.

FIG. 5 is a schematic view of application of the specific embodiment of the present invention. Referring to FIG. 2 through FIG. 4, to start installing the mutually inductive resonant antenna 1 of the present invention, a user gets the mutually inductive resonant antenna 1 electrically connected to a signal transmission line 2. The signal transmission line 2 has at least one third conductive core wire 21, a third insulating layer 22, a third mesh-like conductive layer 23, and a fourth insulating layer 24. The third insulating layer 22 is arranged in a pipe-shaped configuration to enclose the third conductive core wire 21. The third mesh-like conductive layer 23 is arranged in a pipe-shaped configuration to enclose the third insulating layer 22. The fourth insulating layer 24 is arranged in a pipe-shaped configuration to enclose the third mesh-like conductive layer 23. At one end of the signal transmission line 2, the third conductive core wire 21 is exposed so as to be electrically connected to the second mesh-like conductive layer 121 of the mutually inductive resonant antenna 1. The other end of the signal transmission line 2 is electrically connected to a plug 25. Then, the plug 25 can be electrically connected to intended electronic devices, such as a satellite navigation system, a radio, or any other electronic devices. To protect the mutually inductive resonant antenna 1 and the signal transmission line 2 against invading foreign bodies and destructive external forces, the junction of the mutually inductive resonant antenna 1 and the signal transmission line 2 is enclosed by a third protective sleeve 33. To eliminate ambient noise or surge, a plurality of bead cores 4 is disposed at the signal transmission line 2.

Figure 6:
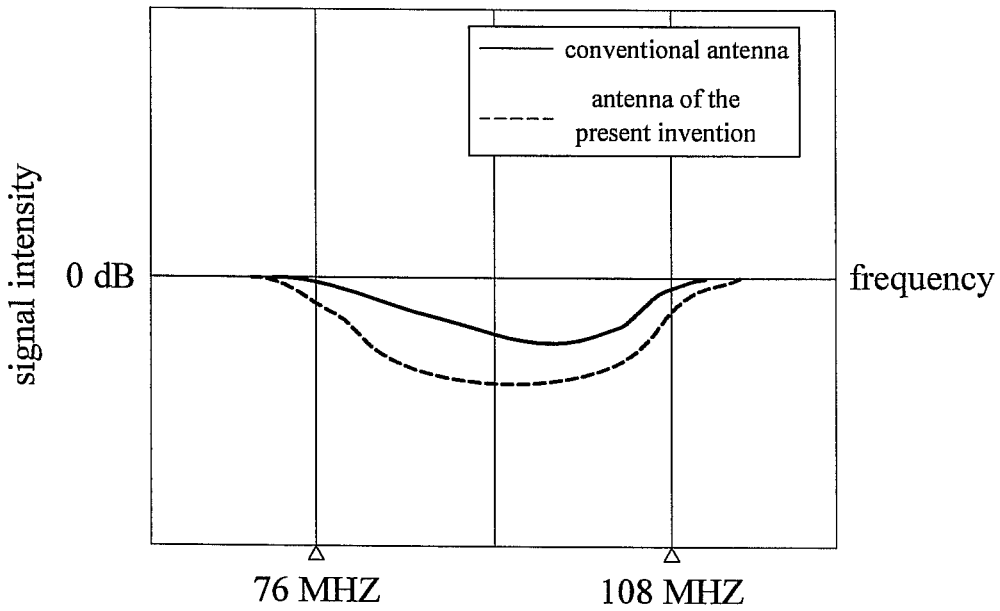
FIG. 6 is a schematic view of a graph of signal intensity against frequency of the specific embodiment of the present invention.

Referring to FIG. 6, there is shown a schematic view of a graph of signal intensity against frequency of the specific embodiment of the present invention. As shown in the diagram, the mutually inductive resonant antenna of the present invention outperforms a conventional antenna in reception capability at the two frequency domains, namely 76 MHz~90 MHz (Japan) and 88 MHz~108 MHz (Taiwan).

The present invention is disclosed above by specific embodiments. However, persons skilled in the art should understand that the embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A mutually inductive resonant antenna for receiving FM or TMC radio waves, the mutually inductive resonant antenna comprising:

a first antenna having at least one first conductive core wire and a first insulating layer, the first insulating layer enclosing the first conductive core wire; and a second antenna having a second mesh-like conductive layer and a second insulating layer, the second mesh-like conductive layer enclosing a section of the first antenna such that another section of the first antenna is exposed, the second insulating layer enclosing the second mesh-like conductive layer, wherein a section of the second mesh-like conductive layer is extended from the first antenna and electrically connected to a signal transmission line, wherein the second mesh-like conductive layer is not in contact with the first conductive core wire.

2. The mutually inductive resonant antenna of claim 1, wherein the first antenna is of a length ranging between 75 cm and 85 cm, and the second antenna is of a length ranging between 60 cm and 70 cm.

3. The mutually inductive resonant antenna of claim 1, wherein another end of the first antenna is enclosed by a first protective sleeve, wherein a portion of the first antenna is exposed from the second antenna, and the exposed portion of the first antenna is enclosed by a second protective sleeve.

* * * * *